United States Patent [19]

Schlienger

[11] 4,331,828

[45] May 25, 1982

[54] APPARATUS FOR MOUNTING A CRUCIBLE WITHIN AN ELECTRIC FURNACE

[75] Inventor: Max P. Schlienger, Ukiah, Calif.

[73] Assignee: Retech, Inc., Ukiah, Calif.

[21] Appl. No.: 229,429

[22] Filed: Jan. 29, 1981

[51] Int. Cl.[3] ..... H05B 5/00

[52] U.S. Cl. ..... 373/153; 373/128; 373/158

[58] Field of Search ..... 13/27, 25; 219/10.67, 219/10.79

[56] References Cited

U.S. PATENT DOCUMENTS 2,675,414 4/1954 Capita ..... 13/27

2,890,258 6/1959 Krall et al. ..... 13/27 X

*Primary Examiner*—Roy N. Envall, Jr.

*Attorney, Agent, or Firm*—Townsend and Townsend

[57] ABSTRACT

A rotatable mounting for the crucible of an electric induction furnace is disclosed. The mounting apparatus includes an access cylinder rotatably mounted within a tubular flange on one wall of the furnace enclosure. Positive and negative slip ring assemblies are mounted at the front of the access cylinder together with a hose reel assembly. The slip ring assemblies each comprise a rotor which is secured to the access cylinder and a stator which is attached to the wall of the enclosure. Flexible electric power leads are attached to terminal blocks at the bottom of each stator and provide both water and electricity to the furnace. Flexible hoses leading from the terminal blocks to the hose reel assembly provide water to the electric heating elements, which are colis made of metal tubing. Electricity is conducted through the slip ring assemblies to power leads which are mounted in the positive and negative rotors. The hose reel has insulated connections to each of the power leads to provide cooling water to the heating elements. The heating elements each have one end connected to a positive power lead and the other end connected to the negative power lead. In this way, both water and electricity are supplied to each of the heating elements. Furthermore, since the various conducting elements of the system remain spatially fixed relative to one another, the total system inductance remains unchanged while the crucible mount is rotated. Precise temperature control of the furnace is thereby facilitated.

27 Claims, 7 Drawing Figures

APPARATUS FOR MOUNTING A CRUCIBLE WITHIN AN ELECTRIC FURNACE

BACKGROUND OF THE INVENTION

1. Field of the Invention

The present invention relates generally to the field of electric furnaces. More particularly, it relates to an electric furnace having a rotatably mounted crucible inside an enclosure.

2. Description of the Prior Art

Electric induction furnaces are used, among other purposes, for melting metals which have very high melting points, such as titanium which becomes molten at a temperature of approximately 3000° F. In casting such metals, it is very important that the temperature be accurately controlled and variations should, typically, not exceed 15° F.

An induction furnace typically comprises an enclosure having an access door. Through one wall of the enclosure, which may be the access door, a crucible is mounted for containing the metal after it has become molten. The electric induction coils surround the crucible and are internally water cooled to prevent melting. The space within the enclosure is maintained under vacuum and means are provided to tilt the crucible in order to pour the molten metal therefrom, frequently directly into appropriately positioned molds.

To supply the required electric current and cooling water to the induction coils of the crucible, flexible water cooled power cables were heretofore attached to the coils with unions. To enable the required rotational movement of the crucible so that it can be tilted for pouring molten metal therefrom, the hoses were given sufficient lengths so that they could be twisted upon the tilting of the crucible.

This arrangement has a number of drawbacks. First, because of the heavy current carried in the hoses, they are relatively stiff. As a result, the unions coupling the hoses to the coils are subjected to relatively heavy stresses and they have a tendency to work loose. This can result in unacceptable water leakage. Thus, it has been necessary to constantly inspect and retighten the unions and, if they become worn, to replace them with new ones. This is cumbersome, time-consuming and expensive.

A more serious drawback is that each time the crucible is tilted, the relative position of the conductive hoses changes. Such changes in their relative position changes the electric power coupling to the induction coils which changes the induction of the entire system. This, in turn, changes the temperature that is achieved within the crucible for a given power setting. Consequently, with prior art constructions, it was difficult to maintain the required close temperature tolerances within the crucible, which are necessary for high quality melting, and sophisticated and expensive temperature controls had to be provided.

A further shortcoming of the prior art arrangements discussed above is the fact that the angle through which the crucible can be tilted is relatively limited by the ridgidity of the conductive hoses. Although it was possible to tilt the crucible through more than 90° from its vertical melting position into an inclined pouring position, tilting the crucible beyond a total of 120° to 130° was difficult, caused increasingly large forces on the induction coils and the coil-hose unions and, under extreme circumstances, could result in damage to the crucible and induction coils. This is a critical problem because the crucible is normally constructed of low strength material, such as asbestos, refractory brick and the like.

SUMMARY OF THE INVENTION

The present invention overcomes the above-discussed shortcomings of the prior art by providing a rotatable mounting apparatus for a crucible of an electric furnace having a heating element, such as induction coils or a resistance heater, and by connecting the coils with conventional unions to relatively rigid metal tubes that carry both electricity and cooling water. The position of the tubes is fixed with respect to the coils so that changes in the inductance of the system due to relative changes in the position of the tubes (or the flexible hoses used in the prior art) do not take place. Accordingly, the present invention greatly facilitates the ease which which the temperature in the crucible can be maintained and controlled within very close tolerances.

To enable such a construction, the present invention provides appropriately constructed slip ring assemblies in which the rigid tubes are mounted to the enclosure and which permit the tubes to rotate with the crucible as it is tilted. Thus, the tilting of the crucible does not generate any stresses or relative movement in the rigid tubes, the induction coils or the interconnecting unions. As a result, the unions do not have a tendency to become loose and require substantially no attention once they are tightened.

Further, since the rigid tubes are mounted in slip ring assemblies, the angle of rotation for the crucible is no longer limited and they can be rotated through as much as 360°. This is helpful during maintenance of the furnace and can further be advantageously used for tilting the crucible in opposite directions so that molten metal can be poured into two different molds, or group of molds, for example, appropriately positioned on each side of the crucible when it is in its upright position.

Moreover, the rigid tubes can be axially movably attached to the slip rings for connecting them with the induction coils. As a result, close tolerances in the relative position of the crucible and/or in the length of the rigid tubes are not necessary. Instead, the present invention enables one to simply position the tubes so that they engage the ends of the inductance coils whereupon the unions are tightened and the tubes are fixed to the slip ring assembly, typically by tightening holding clamps or the like.

The crucible support for the present invention, including the water and current connections for the induction coils, is further ideally suited for mounting to an access door for the enclosure of the crucible. By mounting it thereon, the entire crucible, including its support, can be swung into the open with the door for ready access, inspection, maintenance or replacement work.

Broadly speaking, therefore, the present invention provides a support, including electrical and water connections for a crucible of an electric furnace, such as an induction furnace having one or more water-cooled induction coils, which has substantially rigid, electrically conductive tubes connected to the coils and extending therefrom in fixed relative positions, preferably to the exterior of an enclosure for the crucible. An electric slip ring assembly connects the tubes to a fixed electric power source for the furnace in such a manner that the tilting of the crucible will not change the relative position of the tubes. Similarly, the interiors of the tubes are connected to a fixed water source on the exterior of the enclosure so that the tilting of the crucible will not affect the relative position of the tubes.

DESCRIPTION OF THE PREFERRED EMBODIMENT

Figure 1:
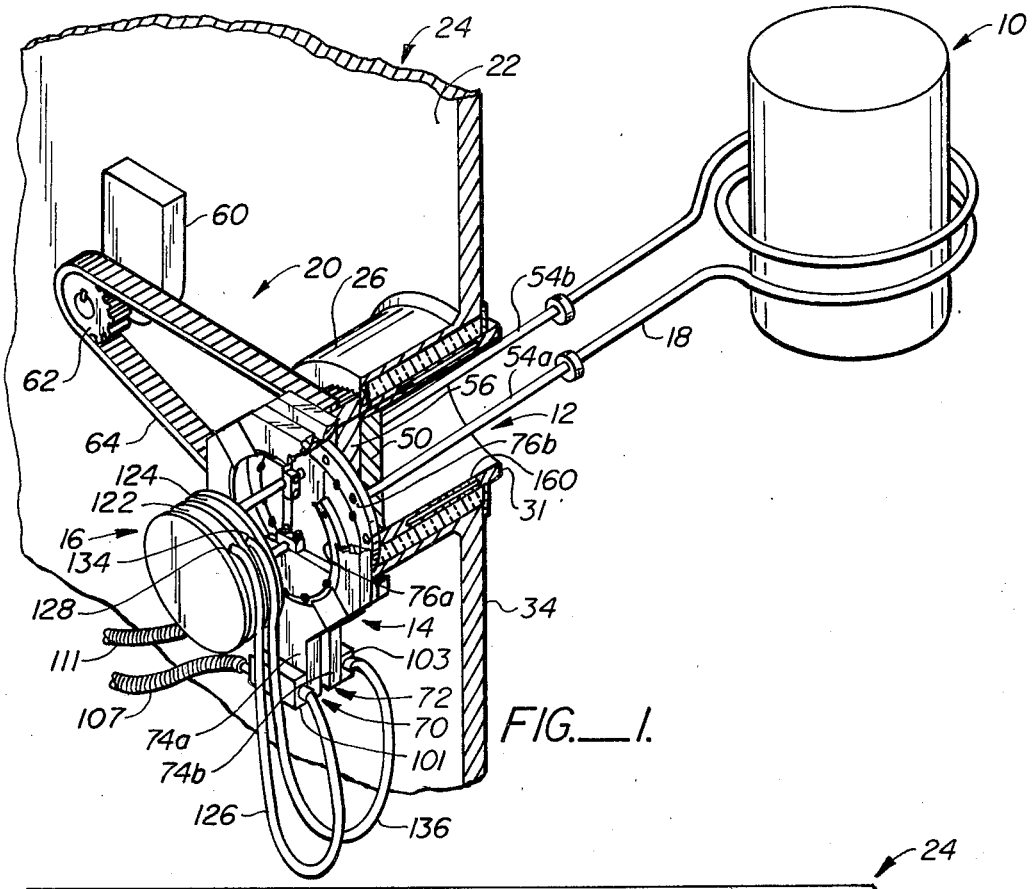
FIG. 1 is a perspective view of the major subassemblies of the present invention shown in Section.
Figure 2:
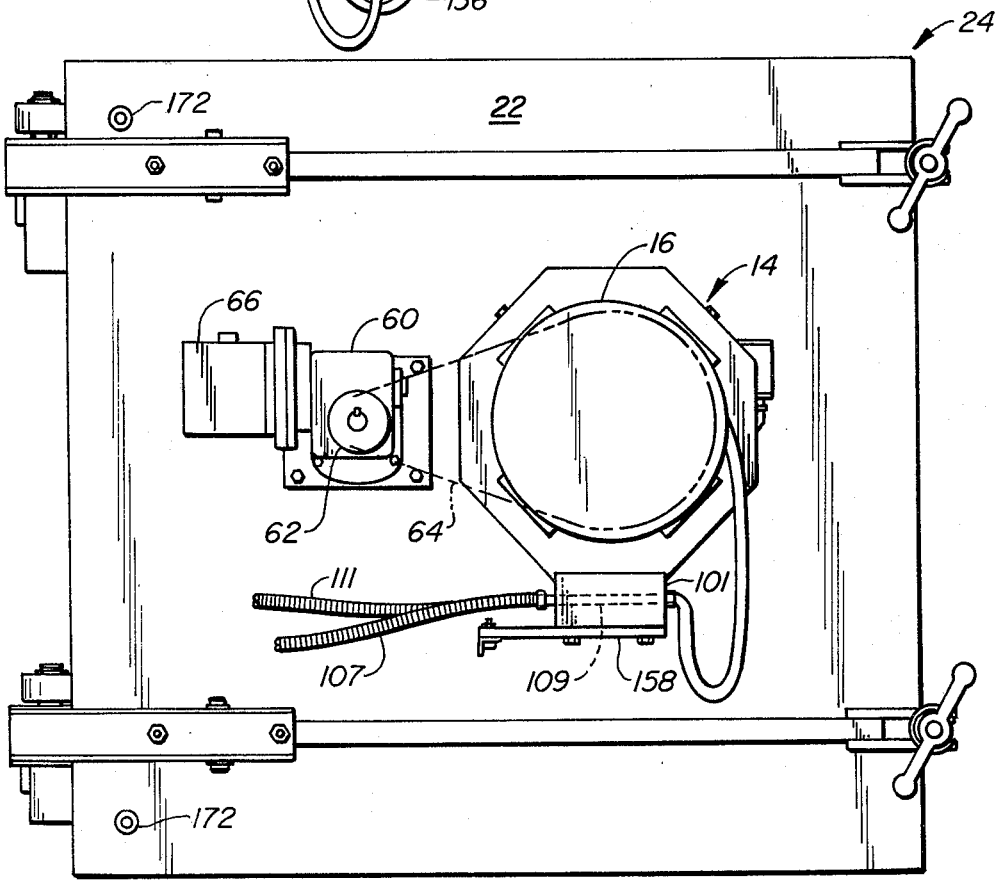
FIG. 2 is a front elevational view of the furnace enclosure of the present invention.

FIG. 1 illustrates the major subassemblies of the mounting apparatus of the present invention including a crucible 10 and, an access cylinder 12, a slip ring assembly 14, a hose reel 16, a heater element in the form of an induction coil (or a resistance heater) 18, and a driver 20 for rotating the access cylinder. The subassemblies are mounted on a door panel 22 of a furnace enclosure 24 (FIG. 2).

Figure 3:
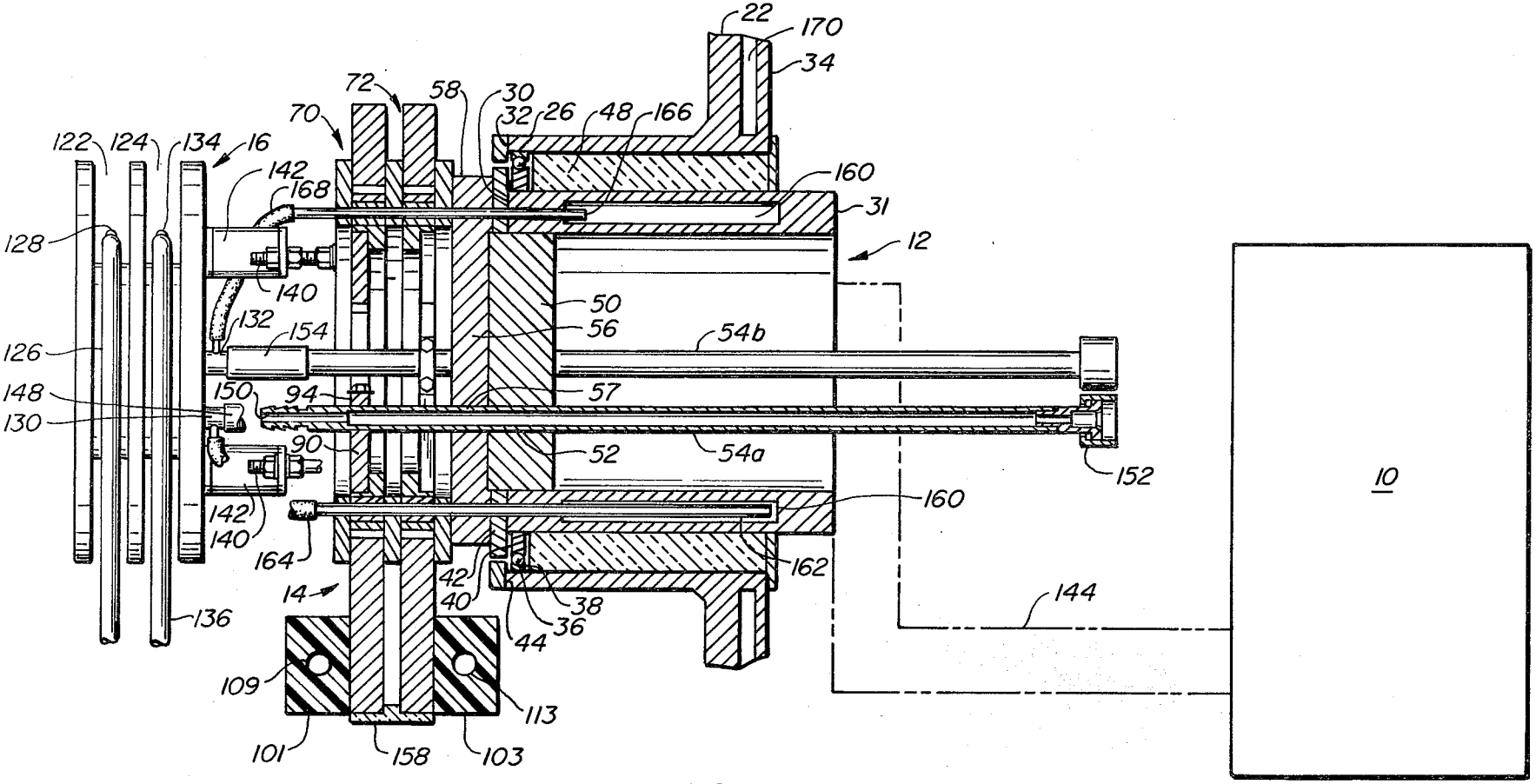
FIG. 3 is an enlarged side elevational view of the subassemblies of the present invention.

Referring now to both FIGS. 1 and 3, the access cylinder 12 is disposed within a hollow tubular flange 26 which projects forwardly, that is to the left as viewed in FIGS. 1 and 3, from door 22. An outside end 30 of the cylinder is approximately aligned with an exterior end 32 of the tubular flange, and an inside end 31 of the cylinder extends past an inside surface 34 of the door and lies inside the furnace enclosure 24.

Referring now particularly to FIG. 3, the mounting of the access cylinder 12 within the tubular flange 26 will be described in greater detail. Bearings 36 are disposed between an outer bearing race 38 mounted within the exterior end 32 of the tubular flange 26 and inner bearing race 40 which is mounted around the outside end 30 of the access cylinder 12. A bearing retainer 42 is fixed to the outside end 30 of the access cylinder and holds the inner bearing race in place. Similarly, an outer bearing retainer 44 is fixed to the exterior end of the tubular flange 26 and seals the bearings from contamination. Insulation 48 is placed between the wall of the cylinder 12 and the tubular flange 26 and provides both thermal and electrical insulation.

A seal disk 50 having four holes 52 (only one being visible in FIG. 3) therethrough is mounted within the outside end 30 of the tubular flange 26 and secured thereto. The holes 52 are provided to allow passage of up to four power leads 54 (two such power leads **54*a*, 54*b* being visible in FIG. 3) into the interior of the furnace enclosure 24**. With the exception of the power leads, during operation the interior of the furnace is completely sealed from the outside.

Referring to FIGS. 1 and 2, a gear 56 is secured to the cylinder 12 and lies flush against the front surfaces of both the seal disk 50 and the bearing retainer 42 in a manner discussed fully hereinafter. The gear has four holes 57 therethrough which are ligned with the holes 52 in the seal disk. The gear has a peripheral surface 58 which is engaged by a drive belt 64 of driver 20 to rotate the access cylinder 12 together with the components mounted theron. The driver 20 also includes an electric motor 60 which drives a sprocket 62 that is engaged by the drive belt. A motor controller 66 is provided to initiate and terminate the rotation of the sprocket 62 to thereby control the tilting of the crucible 10 as desired is required for melting, pouring, maintenance and the like. Such motor controllers are well known in the prior art and will not be described further herein.

Figure 4B:
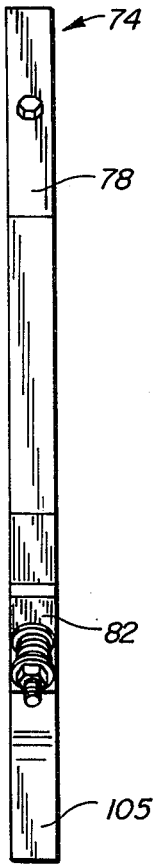
FIG. 4B is a side elevational view of the stator of the present invention taken along line 4B—4B of FIG. 5A.
Figure 4A:
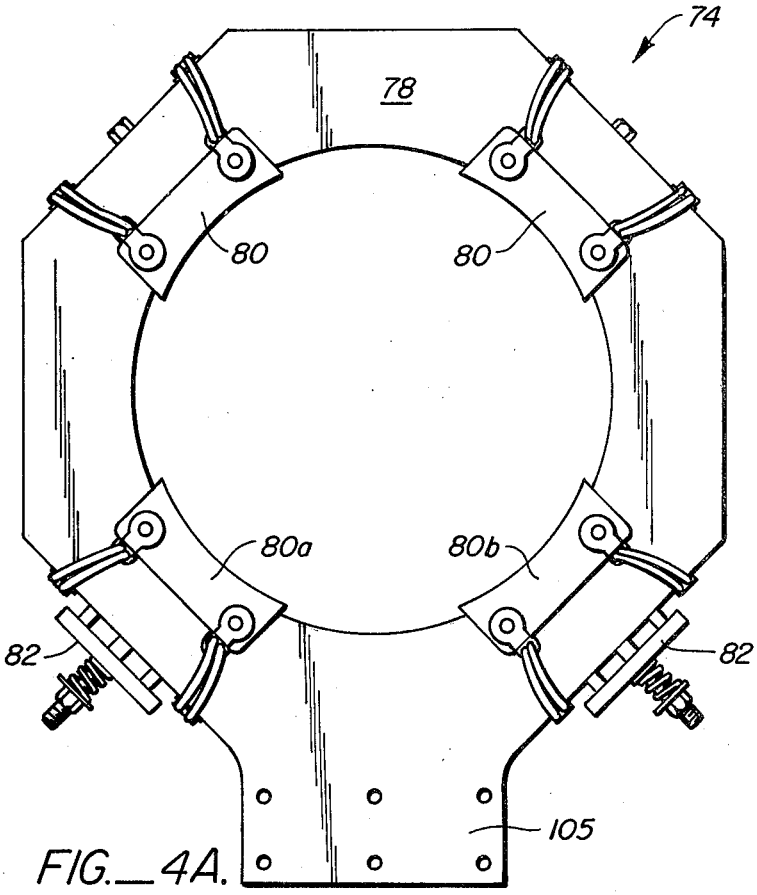
FIG. 4A is a front elevational view of the stator of the present invention.

Referring to FIGS. 1 and 3, the slip ring assembly 14 includes a positive slip ring 70 and a negative slip ring 72. Each slip ring comprises a stator 74, illustrated in detail in FIGS. 4A and 4B, and a rotor 76, illustrated in detail in FIGS. 5A and 5B. The positive stator and rotator will be designated **74*a* and 76*a*, respectively, while the negative stator and rotor will be designated 74*b* and 76*b***, respectively.

The stator 74 (FIGS. 4A and 4B) is a metal ring 78 having four brushes 80 mounted thereabout. The rotor 76 is mounted inside the ring 78 and engages the four brushes 80. Spring mounting plates 82 are provided to adjust the positions of the lower brushes **80*a*, 80*b***, to insure that a good electrical connection is maintained between the brushes and the rotor at all times.

Figure 5A:
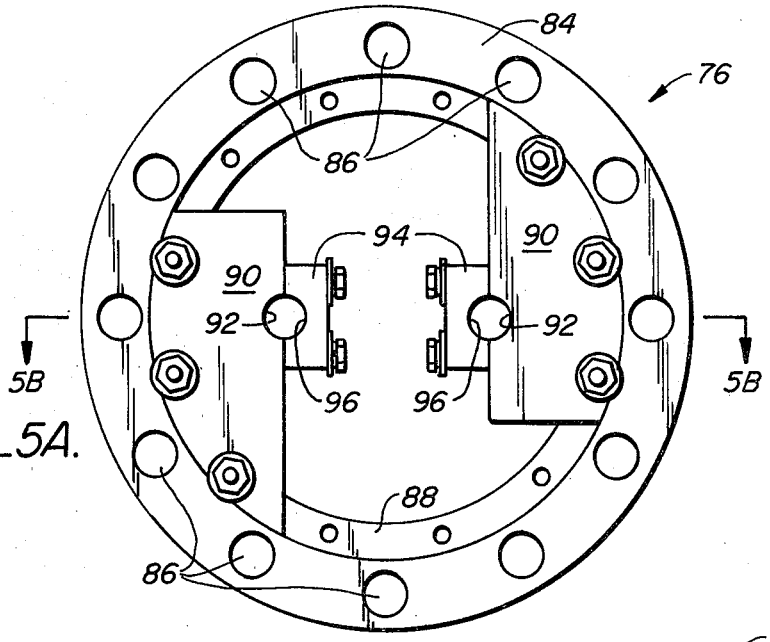
FIG. 5A is a front elevational view of the rotor of the present invention.
Figure 5B:
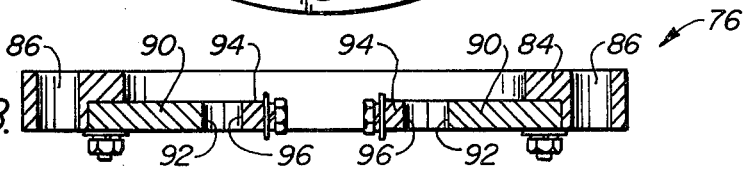
FIG. 5B is a top sectional view of the rotor of the present invention taken along line 5B—5B of FIG. 5A.

Referring to FIGS. 5A and 5B, the rotor 76 comprises an outer ring 84 having a plurality, say 12 circular holes 86 circumferentially spaced about the radial surface thereof. A flange 88 projects radially inward from the outer ring. A pair of blocks 90 are bolted to the flange 88 and each block has a semi-circular depression 92. A clamp 94, having a corresponding semi-circular depression 96 is bolted to each block 90 so that the depressions 92 and 96 together form a circular hole for receiving a power lead 54. Thus, two power leads may be received by each rotor and the mounting apparatus of the preferred embodiment can supply power and water for up to two induction coils. Only one such coil is illustrated for clarity, however. The outer ring 84, the clamp block 90 and the clamps 94 are all made of metal so that the rotor 76 is able to conduct electricity from the brushes 80 of the stator 74 to the power leads 54.

As illustrated in FIGS. 1 and 3, a positive terminal block 101 and a negative terminal block 103 are mounted on tabs 105 (FIGS. 4A and 4B) at the bottom of the positive stator **74*a* and the negative stator 74*b*, respectively. The terminal blocks 101, 103 form junctions between the furnace and both a remote electricity supply and a remote cooling water supply (not shown). A flexible, power cable 107 supplies cooling water and electricity to one end of a passageway 109 (see FIG. 2) through the positive terminal block 101. A similar flexible, metalized hose 111 is connected to one end of a passageway 113 (FIG. 3) through the negative terminal block 103**, carries away the heated cooling water and completes the connection to the electric power source for the furnace.

The hose reel 16 is a cylinder having two annular channels 122, 124 about its periphery. A flexible, nonconducting, e.g., plastic hose 126 connects the outlet of the passageway 109 through the positive terminal block 101 with a supply inlet 128 in the first annular channel 122 on the hose reel. The supply inlet is internally connected with a pair of supply outlets 130, one of which is illustrate in FIG. 3, for supplying cooling water to the furnace. The supply outlets are located on the rear of the hose reel. A pair of return inlets 132, one of which is shown in FIG. 3, for receiving heated cooling water from the furnace are also located on the rear of the hose reel. The return inlets are internally connected with a return outlet 134 located in the second annular channel 124 and connected to a second flexible non-conducting hose 136. The second hose carries the heated cooling water from the furnace to the negative terminal block 103, from which it is carried away in the metalized hose 111.

Referring to FIG. 3, four bolts 140 (only two of which may be seen in FIG. 3) are used to secure the hose reel 16, the slip rings 70, 72, and the gear disk 56 to the access cylinder 12. Four brackets 142 (only two of which may be seen in FIG. 3) attach the hose reel to the bolts. The position of the brackets on the bolts is adjustable so that the distance between the hose reel and the furnace may be varied. The bolts pass through four of the holes 86 in the rotors 76 of the slip rings 70, 72 and are received in the outside end 30 of the access cylinder 12. Thus, the hose reel, the rotors, the gear disk, and the access cylinder are firmly held together so that they will rotate as a unit when the driver 20 is activated. Additionally, the crucible 10 is secured to the inside end 31 of the access cylinder by a bracket 144, as shown in phatom in FIG. 3. Thus, the crucible is tilted when the driver is activated.

The positive power lead **54*a* for the induction coil of the crucible is mounted at its forward end in the rotor 76*a* of the positive slip ring 70, as shown in FIGS. 1 and 3, with block 90 and the clamp 94, as described hereinbefore. The rotor 76*b* of the negative slip ring 72 is oriented 90° out of alignment with the positive rotor 76*a*, as best seen in FIG. 1. Thus the positive power lead bypasses the negative slip ring 72 before passing through the holes 52, 57 in the seal disk 50 and the gear disk 56, respectively. The power lead is isolated from both the seal disk and the gear disk by a sleeve made of insulating material (not shown). Similarly, the negative power lead 54*b* is clamped in the rotor 76*b* of the negative slip ring 72 and bypasses the positive slip ring 70**.

The power leads 54 are hollow metal tubes (see positive power lead **54*a*, shown in cross-section in FIG. 3) which supply both water and electricity to the induction coil 18. A sleeve 148 (a portion of which is shown in FIG. 3) connects the cooling water supply outlet 130 at the rear of the hose reel 16 to an opening 150 in the forward end of the positive power leads 54*a*. A union 152, located at the opposite end of the positive power lead 54*a* secures one end of the induction coil to the positive power lead, supplying both a hydraulic and electrical interface. The opposite end of the induction coil is similarly connected to the negative power lead 54*b*, as best seen in FIG. 1. A sleeve 154 connects the negative power lead to the return inlet 132 on the hose reel, thus completing the rotatable portion of the cooling water circuit to and from the hose reel. As described before, the rotatable portion of the cooling water circuit is connected to the stationary terminal blocks 101, 103 by flexible hoses 126, 136. Slack in the hoses allows the hose reel to rotate, and excess hose length is "reeled" in channels 122, 124 as the hose reel is rotated in the counter-clockwise direction and let out as the reel is rotated clockwise. The remaining portion of the cooling water circuit, i.e., the water cooled power cables 107, 111**, remains stationary during operation of the furnace.

The positions of the power leads 54 may be axially adjusted relative to the position of the crucible 10 and the induction coils 18. This is accomplished first by adjusting the position of the hose reel 16 along the mounting bolts 140 inward or outward, as desired. The position of each power lead may then be adjusted by loosening the associated clamp 94 and pushing that power lead in the desired direction. The clamp is tightened when the power lead has been properly located. The associated sleeve (48 or 54) is then inserted to bridge the gap left between the hose reel and the power lead. If necessary, the hose reel may be removed from the bolts 140 to facilitate placing the sleeves on the power leads.

The stators 74, 75 are mounted at their lower ends on an insulating bracket 158 which is attached to the door 22, as shown in FIG. 2. The stators and the associated terminal blocks 101, 103 thus remain stationary relative to the door at all times.

The mounting apparatus for the crucible just described allows rotation of the crucible limited only by the length of the water hoses 126, 136 attached to the hose reel 16. By providing hoses of sufficient length, the crucible can be rotated through as much as 360° or more.

The components of the mounting apparatus are machined to close tolerances 10 or sealed with O-rings or other appropriate seals to ensure that the interior of the furnace enclosure 24 is sealed to the outside. To maintain the adequate seal during operation, it is necessary that both the access cylinder 112 and the door 22 be provided with water cooling to avoid exess thermal expansion. The access cylinder is provided with an annular cavity 160 (FIG. 3) which receives cooling water through a tube 162 which is connected by a flexible branch conduit 164 (a portion of which is shown in FIG. 3) to the cooling water supply outlet 130 on the hose reel. A similar but shorter tube 166 is provided for the return flow of cooling water and is connected to the return inlet 132 by a second flexible branch conduit 168. The door 22 also has a hollow interior 170 through which cooling water flows via connectors 172, shown in FIG. 2.

Although the best mode contemplated for carrying out the present invention has been herein shown and described, it will be apparent that modification and variation may be made without departing from what is regarded to be the subject matter of the invention.

What is claimed is:

1. An electric furnace which receives power from a remote electric power source and which receives cooling water from a remote water source, said furnace comprising:

an enclosure;

a support assembly rotatably mounted in the enclosure;

an electric heating element which may be a water cooled induction coil or a resistance heater mounted on the support assembly;

means for electrically coupling the heating element with the power source, said means for coupling having a first portion which is connected with the support assembly for rotation therewith and a second portion which is fixed with respect to the enclosure and in sliding electrical contact with said first portion to define a current path therebetween, said first portion being symetrically formed with respect to its axis of rotation so that rotation of said first portion does not substantially affect the inductive load of the furnace;

means for supplying cooling water from the remote water source to the electric heating element, said means for supplying water having a first portion which is rotatably connected with the support assembly for rotation therewith and a second portion which is fixed with respect to the enclosure; and means for rotating the support assembly with respect to the enclosure, the first portion of the means for coupling, and the first portion of the means for supplying cooling water so that said support assembly, first portion of the means for coupling electricity, and first portion of the means for supplying cooling water remain in a fixed spatial relationship to one another regardless of the degree of rotation of the support assembly.

2. An electric furnace as in claim 1, wherein said means for coupling includes:

a stator fixedly mounted on the enclosure and which receives electricity from the remote power source;

a rotor connected to the support assembly and positioned to be electrically coupled to the stator regardless of the degree of rotation of the rotor within the stator; and a power conduit fixedly mounted in the rotor at one end and attached to the electric heating element at the other end, whereby electricity is supplied to the heating element regardless of the degree of rotation of the support assembly.

3. An electric furnace as in claim 1, wherein said means for supplying water includes:

hose reel means connected to the support assembly and having first and second conduits which are fixed with respect to the support assembly;

a first, substantially rigid, electrically conductive pipe having ends coupled with the first conduit and the electric heating element, whereby cooling water is supplied to the heating element regardless of the degree of rotation of the support assembly; and a second, substantially rigid, electrically conductive pipe having ends coupled with the first conduit and the electric heating element and at the other end to the return inlet, whereby cooling water is removed from the heating element regardless of the degree of rotation of the support assembly.

4. An electric furnace as in claim 1, wherein said means for coupling and said means for supplying cooling water further include:

a first stator fixedly mounted on the enclosure and which is connected to the electric power source;

a second stator fixedly mounted on the enclosure and connected to the electric power source;

a first rotor which is rotatably mounted on the enclosure and positioned to engage the first stator and to receive electricity therefrom regardless of the degree of rotation of said the first rotor;

a second rotor rotatably mounted on the enclosure and positioned to engage the second stator and to pass electricity therefrom regardless of the degree of rotation of the second rotor;

hose reel means mounted on said support assembly and having a first set of conduits for rotation with the support assembly and a second set of conduits fixed to the enclosure, the supply inlet being connected to the remote source of cooling water, a supply outlet fixed relative to the support assembly and connected to the supply inlet, a return inlet fixed relative to the support assembly, and a return outlet fixed to the enclosure and connected to the second inlet;

a supply conduit connected at one end to the supply outlet and to the first rotor and at the opposite end to the heating element, whereby both water and electricity are supplied to the heating element; and a return conduit connected at one end to the heating element and at the opposite end to the return inlet and the second rotor, whereby both water and electricity are reveived from the heating element.

5. An electric furnace as in claim 4, wherein both the supply conduit and the return conduit are rigid metal tubes capable of carrying both water and electricity.

6. An electric furnace as in claim 1, wherein said support assembly, said means for supplying electricity, and said means for supplying cooling water have a common axis of rotation which lies in the horizontal plane.

7. An electric furnace as in claim 1, wherein said electric heating element is an induction coil having a hollow core for carrying cooling water.

8. An electric furnace as in claim 1, further comprising a second heating element mounted on the support assembly.

9. An electric furnace which receives electricity from a remote power source and cooling water from a remote water source, said electric furnace comprising:

an enclosure;

an access cylinder rotatably mounted through a wall of the enclosure and having a hollow core with one end open to the interior of the enclosure and the other end open to the outside of the enclosure;

a heating element attached to the end of the cylinder inside the enclosure for rotation therewith;

a means for supplying both electricity and water to the heating element, said means for supplying having a first portion fixedly mounted on the enclosure and a second portion fixedly mounted on the access cylinder, and in sliding electrical contact with said first portion, said first and second portions being capable of moving relative to one another whenever the access cylinder is rotated, wherein said second portion is symetrically formed so that rotation of the access cylinder does not substantially affect the inductive load on the furnace; and means for rotating the access cylinder.

10. An electric furnace as in claim 9, wherein the means for supplying both electricity and water passes from the outside end of the access cylinder, through the inside of the cylinder, to the interior of the enclosure; and wherein the hollow core of the access cylinder is insulated to isolate the means for carrying electricity and water.

11. An electric furnace as in claim 9, wherein the means for supplying both electricity and water further includes:

a first stator fixedly mounted on the enclosure and which is connected to a first terminal on the electric power source;

a second stator fixedly mounted on the enclosure and which is connected to a second terminal on the electric power source;

a first rotor mounted on the access cylinder and positioned to engage the first stator, whereby said rotor and stator are electrically coupled regardless of the degree of rotation of the positive rotor;

a second rotor mounted on the access cylinder and positioned to engage the negative stator, whereby said rotor and stator are electrically coupled regardless of the degree of rotation of the negative rotor;

a hose reel mounted on the access cylinder and having a supply inlet fixed relative to the enclosure, said supply inlet being connected to the remote source of cooling water, a supply outlet fixed relative to the support assembly a return inlet fixed relative to the support assembly, and a return outlet fixed to the enclosure;

a supply conduit connected at one end to the supply outlet and at the opposite end to the heating element and further connected to electrically couple the first rotor to the neating element, whereby both water and electricity are supplied to the heating element; and a return conduit connected at one end to the heating element and at the opposite end to the return inlet and further connected to electrically couple the second rotor to the heating element, whereby both water and electricity are returned from the heating element.

12. An electric furnace as in claim 11, wherein both the supply conduit and the return conduit are rigid metal tubes capable of carrying water and conducting electricity.

13. An electric furnace as in claim 9, wherein said support assembly, said means for supplying electricity and said means for supplying cooling water have a common axis of rotation which lies in the horizontal plane.

14. An electric furnace as in claim 9, wherein said electric heating element is an induction coil.

15. An electric furnace as in claim 9, further comprising a second heating element mounted on the support assembly.

16. An improved electric furnace, said furnace including an enclosure, a crucible rotatably mounted on a wall of the enclosure, an electric heating element comprising a hollow metal tube fixedly secured to the crucible, the heating element having an inlet end and an outlet end, wherein the improvement comprises:

an access cylinder rotatably mounted through the wall of the enclosure, said access cylinder having an annular cavity for passing cooling water therethrough, and an inlet and an outlet for receiving and discharging the cooling water;

a hose reel fixedly attached to the access cylinder and having a flexible supply inlet connected to the source of cooling water, a rigid supply outlet connected to both the inlet of the heating element and the inlet of the access cylinder, a rigid return inlet connected both to the outlet of the heating element and the outlet of the access cylinder, and a flexible return outlet connected to the cooling water discharge;

a first slip ring assembly including a first stator which is fixedly mounted on the wall of the enclosure and a first rotor which is secured to the access cylinder, the first stator and rotor forming a conducting path therebetween regardless of the rotational orientation of the first rotor; said first rotor being electrically coupled to one end of the electric heating element;

a second slip ring assembly including a second stator which is fixedly mounted on the wall of the enclosure and a second rotor which is secured to the access cylinder, the second stator and rotor forming a conducting path therebetween regardless of the rotational orientation of the second rotor, said second rotor being electrically coupled to the other end of the electric heating element to form a complete electric circuit; and means for rotating the access cylinder, the hose reel, the first rotor and the second rotor in unison so that an uninterrupted supply of water and electricity is provided to the electric heating element regardless of the orientation thereof.

17. An electric furnace which receives power from a remote electric power source and which receives cooling water from a remote water source, said furnace comprising:

an enclosure;

a support assembly rotatably mounted in the enclosure;

an electric heating element which may be a water cooled induction coil or a resistance heater mounted on the support assembly;

a stator fixedly mounted on the enclosure and which receives electricity from the remote power source;

a rotor connected to the support assembly and positioned to be electrically coupled to the stator regardless of the degree of rotation of the rotor within the stator;

a power conduit fixedly mounted in the rotor at one end and attached to the electric heating element at the other end, whereby electricity is supplied to the heating element regardless of the degree of rotation of the support assembly;

means for supplying cooling water from the remote water source to the electric heating element, said means for supplying water having a first portion which is rotatably connected with the support assembly for rotation therewith and a second portion which is fixed with respect to the enclosure; and means for rotating the support assembly with respect to the enclosure, the first portion of the means for coupling, and the first portion of the means for supplying cooling water so that said support assembly, first portion of the means for coupling electricity, and first portion of the means for supplying cooling water remain in a fixed spatial relationship to one another regardless of the degree of rotation of the support assembly.

18. An electric furnace as in claim 17, wherein said means for supplying water includes:

hose reel means connected to the support assembly and having first and second conduits which are fixed with respect to the support assembly;

a first, substantially rigid, electrically conductive pipe having ends coupled with the first conduit and the electric heating element, whereby cooling water is supplied to the heating element regardless of the degree of rotation of the support assembly; and a second, substantially rigid, electrically conductive pipe having ends coupled with the first conduit and the electric heating element and at the other end to the return inlet, whereby cooling water is removed from the heating element regardless of the degree of rotation of the support assembly.

19. An electric furnace as in claim 17, further comprising a second heating element mounted on the support assembly.

20. An electric furnace as in claim 17, wherein said support assembly, said means for supplying electricity, and said means for supplying cooling water have a common axis of rotation which lies in the horizontal plane.

21. An electric furnace as in claim 17, wherein said electric heating element is an induction coil having a hollow core for carrying cooling water.

22. An electric furnace which receives power from a remote electric power source and which receives cooling water from a remote water source, said furnace comprising:

an enclosure;

a support assembly rotatably mounted in the enclosure;

an electric heating element which may be a water cooled induction coil or a resistance heater mounted on the support assembly;

a first stator fixedly mounted on the enclosure and which is connected to the electric power source;

a second stator fixedly mounted on the enclosure and connected to the electric power source;

a first rotor which is rotatably mounted on the enclosure and positioned to engage the first stator and to receive electricity therefrom regardless of the degree of rotation of said the first rotor;

a second rotor rotatably mounted on the enclosure and positioned to engage the second stator and to pass electricity therefrom regardless of the degree of rotation of the second rotor;

hose reel means mounted on said support assembly and having a first set of conduits for rotation with the support assembly and a second set of conduits fixed to the enclosure, the supply inlet being connected to the remote source of cooling water, a supply outlet fixed relative to the support assembly and connected to the supply inlet, a return inlet fixed relative to the support assembly, and a return outlet fixed to the enclosure and connected to the second inlet;

a supply conduit connected at one end to the supply outlet and to the first rotor and at the opposite end to the heating element, whereby both water and electricity are supplied to the heating element;

a return conduit connected at one end to the heating element and at the opposite end to the return inlet and the second rotor, whereby both water and electricity are received from the heating element; and means for rotating the support assembly with respect to the enclosure, the first portion of the means for coupling, and the first portion of the means for supplying cooling water so that said support assembly, first portion of the means for coupling electricity, and first portion of the means for supplying cooling water remain in a fixed spatial relationship to one another regardless of the degree of rotation of the support assembly.

23. An electric furnace as in claim 23, wherein both the supply conduit and the return conduit are rigid metal tubes capable of carrying both water and electricity.

24. An electric furnace which receives electricity from a remote power source and cooling water from a remote water source, said electric furnace comprising:

an enclosure;

an access cylinder rotatably mounted through a wall of the enclosure and having a hollow core with one end open to the interior of the enclosure and the other end open to the outside of the enclosure;

a heating element attached to the end of the cylinder inside the enclosure for rotation therewith;

a first stator fixedly mounted on the enclosure and which is connected to a first terminal on the electric power source;

a second stator fixedly mounted on the enclosure and which is connected to a second terminal on the electric power source;

a first rotor mounted on the access cyliner and positioned to engage the first stator, whereby said rotor and stator are electrically coupled regardless of the degree of rotation of the positive rotor;

a second rotor mounted on the access cyliner and positioned to engage the negative stator, whereby said rotor and stator are electrically coupled regardless of the degree of rotation of the negative rotor;

a hose reel mounted on the access cylinder and having a supply inlet being connected to the remote source of cooling water, a supply outlet fixed relative to the support assembly a return inlet fixed relative to the support assembly, and a return outlet fixed to the enclosure;

a supply conduit connected at one end of the supply outlet and at the opposite end to the heating element and further connected to electrically couple the first rotor to the heating element, whereby both water and electricity are supplied to the heating element;

a return conduit connected at one end to the heating element and at the opposite end to the return inlet and further connected to electrically couple the second rotor to the heating element, whereby both water and electricity are returned from the heating element; and means for rotating the access cylinder.

25. An electric furnace as in claim 24, wherein both the supply conduit and the return conduit are rigid metal tubes capable of carrying water and conducting electricity.

26. An electric furnace as in claim 24, wherein said electric heating element is an induction coil.

27. An electric furnace as in claim 24, further comprising a second heating element mounted on the support assembly.

* * * * *